United States Patent [19]

Poersch et al.

[11] Patent Number: 4,630,987

[45] Date of Patent: Dec. 23, 1986

[54] PERIPHERAL AUXILIARY SYSTEM FOR THE AUTOMATIC FEEDING AND UNLOADING OF A STAMPING/NIBBLING MACHINE

[75] Inventors: Hans Poersch; Gustav Stark, both of Nuremberg, Fed. Rep. of Germany

[73] Assignee: Siemens Aktiengesellschaft, Berlin/Munich, Fed. Rep. of Germany

[21] Appl. No.: 638,820

[22] Filed: Aug. 8, 1984

[30] Foreign Application Priority Data

Aug. 18, 1983 [DE] Fed. Rep. of Germany ..... 3329902

[51] Int. Cl.[4] ..... B65G 60/00

[52] U.S. Cl. ..... 414/32; 271/91; 271/108; 294/65; 414/80; 414/121; 901/40

[58] Field of Search ..... 414/32, 71, 72, 80, 414/82, 121, 736, 737, 744 B, 752; 294/65; 271/90, 91, 107, 108; 901/40

[56] References Cited

U.S. PATENT DOCUMENTS

| | | | |
|---|---|---|---|
| 3,358,853 | 12/1967 | Thomas et al. | 414/80 |
| 3,391,805 | 7/1968 | Baden | 414/72 X |
| 3,973,795 | 8/1976 | Goransson | 294/65 |
| 4,129,328 | 12/1978 | Littell | 294/65 |
| 4,228,993 | 10/1980 | Cathers | 294/65 X |

FOREIGN PATENT DOCUMENTS

| | | | |
|---|---|---|---|
| 1051737 | 2/1959 | Fed. Rep. of Germany | 414/80 |
| 1195677 | 6/1965 | Fed. Rep. of Germany | 414/72 |
| 52-75770 | 6/1977 | Japan | 414/121 |
| 663465 | 11/1977 | U.S.S.R. . | |

*Primary Examiner*—Leslie J. Paperner
*Attorney, Agent, or Firm*—Mark H. Jay

[57] ABSTRACT

The invention concerns a peripheral auxiliary system for the automatic feeding and unloading of a stamping-/nibbling machine. In machines of this kind, the blanks have previously beed fed in by automatic devices. Other transport or depositing devices have been provided for the stamped parts and the stamped-out blanks. For these purposes, an industrial robot with a gripping mechanism is be used. According to the invention, the gripping mechanism of the robot is also designed to remove the stamped parts, and a stacking means is provided, whose delivery surface can be swiveled and displaced uniformly in one operation.

10 Claims, 10 Drawing Figures

PERIPHERAL AUXILIARY SYSTEM FOR THE AUTOMATIC FEEDING AND UNLOADING OF A STAMPING/NIBBLING MACHINE

BACKGROUND OF THE INVENTION

The invention concerns a peripheral auxiliary system for the automatic feeding and unloading of a stamping-/nibbling machine.

Stamping/nibbling machines are used for stamping out finished parts of a prescribed geometry from blanks with a substantial surface area. To guide the blanks, a stamping/nibbling machine of this kind is equipped with a guide bar with which the blank can be moved in a specific area. A stamping head, which is provided with the tool appropriate for the respective application from a related revolving magazine of cutting tools, is used to stamp out parts with the desired geometry. In the operation of a stamping/nibbling machine, the following steps are performed consecutively:

(a) Placement of the blanks:
(b) Stamping;
(c) Removal of the finished parts and any waste pieces; and
(d) removal of the remaining stamped-out blank or the remaining strips.

Until now steps (a), (c) and (d) have usually been performed manually. In the case of modern numerically controlled stamping/nibbling machines specific solutions are already known for the automation of the steps, which, however, work only for specific tool geometries and are integrated, in each case, in the special machine.

One purpose of the invention is to create a peripheral auxiliary system, using an industrial robot, with which the feeding and unloading of a stamping/nibbling machine can be optimized.

SUMMARY OF THE INVENTION

In accordance with the invention there is provided an industrial robot having a gripping mechanism for picking up blanks and stamped parts. There is also provided means for transporting and delivering stamped parts and stamped-out blanks. There is also provided means for stacking stamped-out blanks in piles, said stacking means having a delivery surface which can be swivelled and displaced in one operation.

A particular advantage of the invention is that even stamping/nibbling machines that have previously been manually fed and/or unloaded can be subsequently equipped with it, without the introduction of any mechanical changes. The arrangement as a whole provides a unit with which an extraordinary variety of tools can be manipulated according to a program. Essential elements of the invention include the gripping mechanism on the one hand and the stacking means on the other. Since the invention is used with the stamping machine to handle both the large-surface feed blanks and the finished parts, which may be small and, when the bar guide extends far into the machine, which are accessible only through a narrow channel, the gripping mechanism may be advantageously designed in the shape of a V and may be equipped, as an adhesive device working on the vacuum principle, with suction cups at various intervals, that may be changed if necessary and that can be activated in accordance with the program. In a preferred embodiment it is possible to activate specific suction cups in groups. This is advantageous especially for the residual stamped-out blanks, which, for purposes of removal can be seized by the suction cups only, in practice, along an edge. To accomplish this, there is also provided a means for stacking stamped-out blanks in piles, whose delivery surface can be uniformly swiveled and shifted in one operation. A depositing device of this kind can be a tilt-top table and can pile the residual stamped-out blanks, (which are susceptible of being bent and hooked together) in layers on top of one another.

BRIEF DESCRIPTION OF THE DRAWINGS

Exemplary and non-limiting preferred embodiments of the invention are shown in the drawings, in which.

DETAILED DESCRIPTION OF PREFERRED EMBODIMENTS

Figure 1:
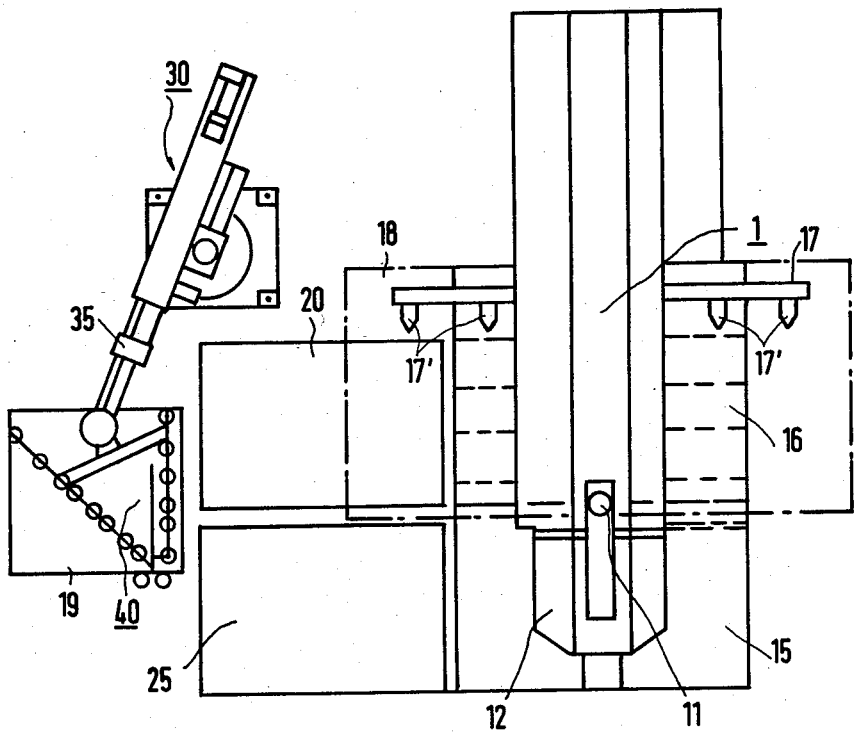
FIG. 1 shows a numerically-controlled stamping/nibbling machine together with apparatus in accordance with the invention.

In all the figures, the same element is indicated by the same reference numeral.

In FIG. 1, reference numeral 1 generally indicates the frame of a stamping/nibbling machine that is numerically controlled using state-of-the-art technology. The stamping head 11 of the machine has a revolving magazine of cutting tools.

For manipulating the blanks, finished parts and stamped-out blanks (not shown) a number of working tables are attached to the stamping/nibbling machine 1. Under the stamping head 11 is a fixed table 15, to the back of which is connected an endless chain link table 16. At the rear end of the endless chain link table 16 is a guide bar 17 which is used to guide the blanks during processing. The outer limits of motion of the guide bar 17 are designated by the rectangular boundary line 18. A tilt-top table 20 serves as an intermediate depositing device, and a delivery table 25 for finished parts is provided. Assigned to the stamping machine 1 is an industrial robot 30 with a manipulating arm 35. Such robots are known by themselves. To the manipulating arm 35 is attached a gripping mechanism 40, with which blanks, finished parts (not shown) and stamped-out blanks (not shown) can be manipulated. The gripping mechanism 40 is described in greater detail below. Also indicated in FIG. 1 is a stack 19 of blanks.

Figures 2, 2A:
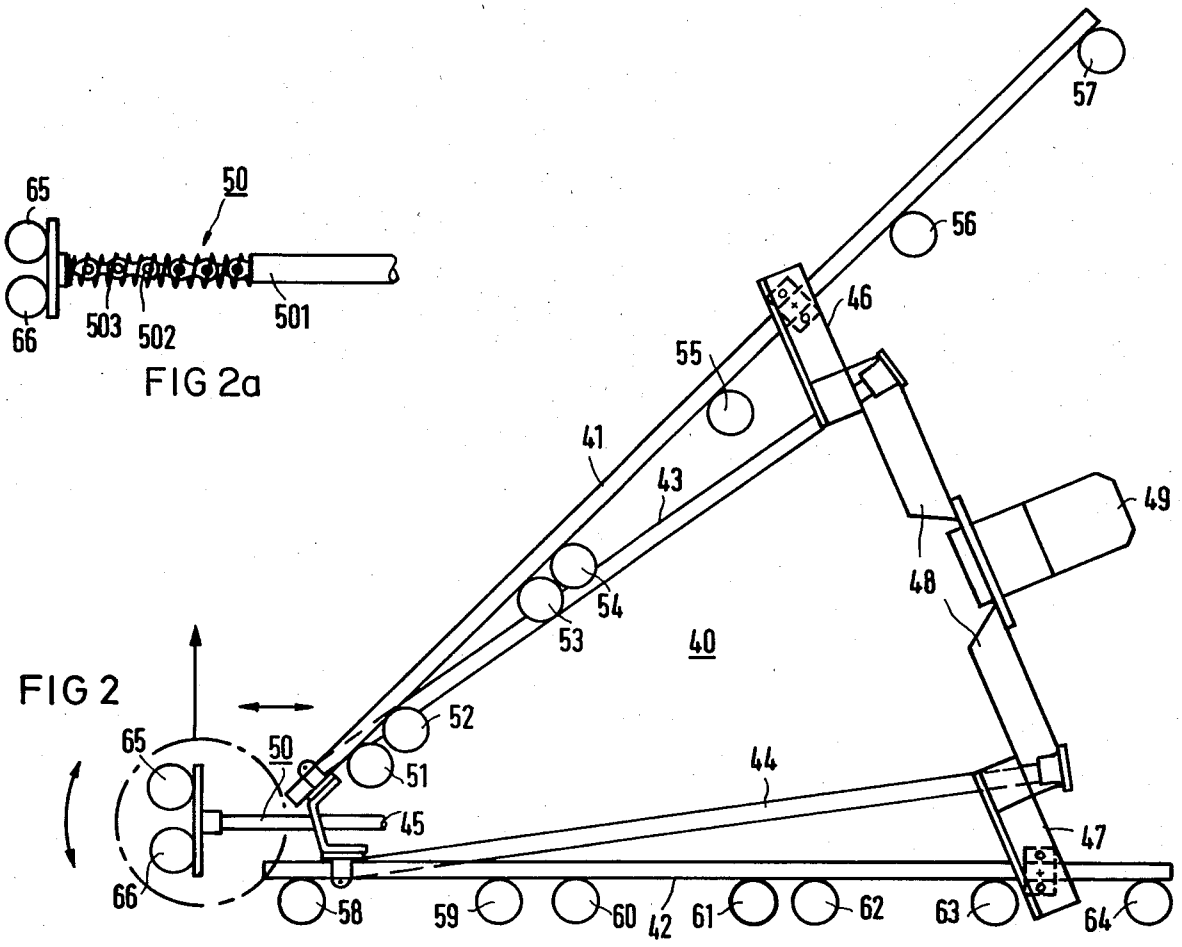
FIG. 2 shows apparatus in accordance with the invention.
FIG. 2*a* shows a detail view of the apparatus within the dotted circle shown in FIG. 2

FIG. 2 shows that the gripping mechanism 40 has a V-shaped frame. The numbers 41 to 44 designate mechanical carriers, which are arranged in the desired geometry by corresponding connecting devices 45 to 48. The robot arm 35 is attached to the gripping mechanism 40 at flange 49.

The gripping mechanism 40 is designed such that the carrying arm 42 comes to rest in each case on the edge of a blank, while the carrying arm 41 lies along the diagonal of a blank. The gripping mechanism 40 uses suction to hold and manipulate flat pieces (such as blanks, stamped parts and/or stamped-out blanks). On both the carriers 41 and 42, there have therefore been mounted suction cups 51 to 64, which can be connected to a pneumatic vacuum system and can be activated individually or in groups to make them adhere to a surface.

In addition, on an extender bracket 50, which can be moved mechanically or pneumatically two front suction cups 65 and 66 have been mounted at a V-shaped angle.

From the sectional drawing for the bracket 50, it is apparent that this arm of the extender can consist of a rod 501 that can be moved along its lengthwise axis, a gear chain 502 and a helical spring 503 which surrounds the chain 502. It is also possible to use a pair of leaf springs to guide the chain. This kind of design is a simple means of ensuring lengthwise and diagonal mobility, with adequate stability of the bracket 50. The bracket 50 is thus designed in such a manner that it can be loaded in a vertical direction, through the action of the suction cups 65 and/or 66, but remains yielding and movable in the horizontal plane.

The suction cups 51 to 66 are arranged on the frame at predetermined intervals. The intervals can be changed manually or according to a program. In this example, it is essential that the individual suction cups 51 to 66 can be activated individually or in groups, according to a control program, because it is necessary to activate different groups or areas of suction cups to manipulate blanks, scraps, finished parts, or stamped-out blanks. This is shown in detail in FIG. 3 for four examples.

Figure 3:
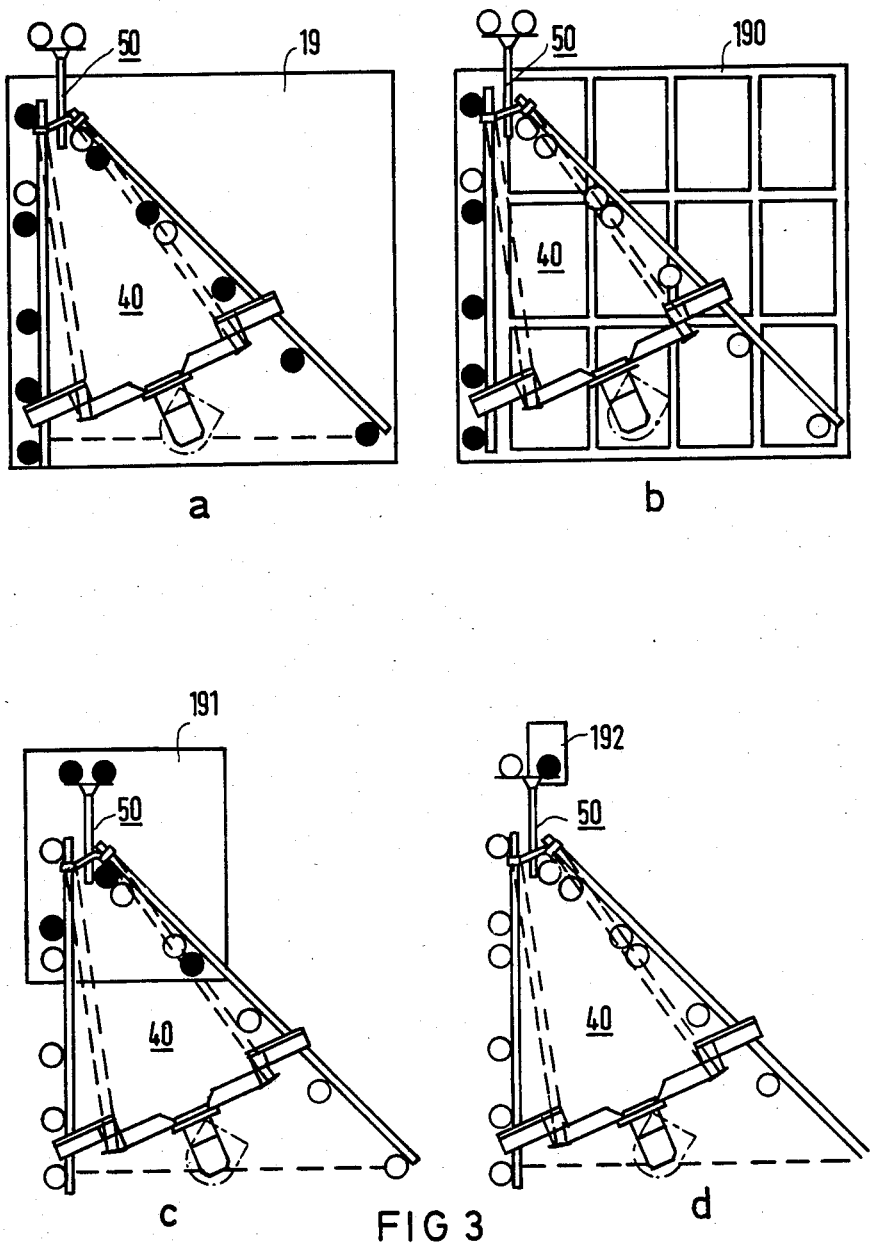
FIGS. 3*a*–3*d* illustrate the operation of the apparatus shown in FIG. 2.

FIG. 3 shows that the V-shaped design of the gripping mechanism 40 with an edge section and a diagonal section, is of advantage for right-angled parts.

In FIG. 3 a, the suction cups shown in black have been activated to lift a blank 19. In this case, as a rule, not all the edge or diagonal suction cups are needed; the suction cups 65, 66 of the bracket 50 are not activated.

In FIG. 3 b, on the other hand, a residual blank 190, out of which the finished parts have been stamped, is to be manipulated. For this purpose, only the suction cups on the edge are required, in which case as is shown below in the description of the operating cycle, a horizontal withdrawal of the stamped-out blank 190 takes place. FIG. 3 c shows the activation of suction cups for a fairly large finished part 191. According to the size of such a part, suction cups in the V-shaped point area, as well as those on the extended bracket 50, are activated. For small finished parts 192, as showing in FIG. 3 d, it may be sufficient if only one suction cup of the extended bracket 50 is activated.

In theory, each suction cup can be activated individually using a magnet valve (not shown) which is operated according to a program. Since it is generally not possible to mount an arbitrarily large number of magnet valves on the robot arm 30, due to its limited carrying capacity, and since the robot 30 itself can offer only a limited number of functions—i.e., switching signals—it is advantageous to activate the suction cups 51 to 66 in groups adapted to the specific problem. Experience has shown that six I/O switching signals will provide a sufficient number of potential combinations. In this case, the selection of the combinations depends not only on the size of the parts, but also on their geometry. For small parts with small or narrow surfaces for the suction cups to adhere to, it may, for example, be necessary to use specially designed suction cup patterns.

Figure 4:
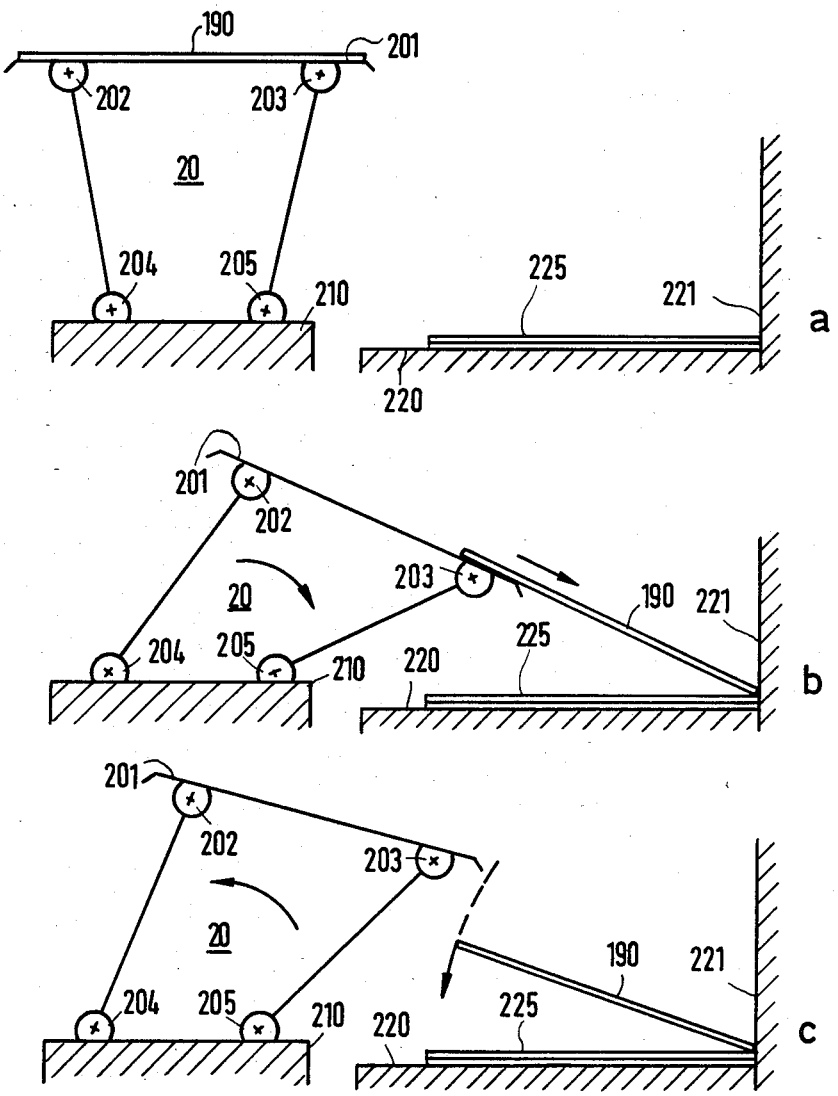
FIGS. 4*a*–4*c* show show apparatus for receiving flat pieces and stacking them.

FIG. 4 schematically illustrates the operation of the tilt-top table 20 for removing the stamped-out blanks. A table of this kind has its delivery surface 201 fastened to the base 210 by means of two mechanical levers extending between four swivel joints 202 to 205. Essentially, the delivery table 201 of a tilt-top table can simultaneously tilt and move linearly. FIGS. 4 a, b and c show this motion. 220 indicates the storage surface for the stamped-out blanks, to which a perpendicular stop surface 221 is attached. When a stamped-out blank 190 is resting on the surface 201, the table 20 can be tipped diagonally. When the surface 201 reaches a specified angle with the horizontal, a stamped-out blank 190 will slowly slip off, as it overcomes the force of friction. However, it is desirable to give the motion of the stamped-out blank 190 a dynamic component. For this purpose, the table 20 is swiveled at a predetermined speed against a lower stop, which may, if necessary, be damped, so that the stamped-out blank 190 shoots diagonally forward against the stop 221. In this case the stamped-out blank 190 slides downward with its forward edge to the level of a stack 225 that has already accumulated. By swiveling back the tilt-top table 20 at a predetermined speed or acceleration, the stamped-out blank 190 remains behind, due to its inertia, and is left propped against the stop surface 221 until the support provided by the surface 201 at the opposite edge no longer exists. The blank 190 then falls onto the already existing stack 225.

The entire operating cycle in this example will now be described, reference being made in this connection to FIGS. 1 to 4 and to FIG. 1 in particular:

With the gripping mechanism 40, a blank 19 is lifted from the stack of blanks and put into the guide bar 17 in a predetermined standard position against the stock stops 17'. In this case the tilt-top table 20 is turned up to support thin, sagging sheet blanks. On the mechanism 40, in this case, in accordance with FIG. 3*a* the "edge" row of suction cups and the "diagonal" row of suction cups 52–53, 55–57 are activated.

For the stamping process, the table 20 is lowered. The numerically controlled stamping/nibbling program then proceeds until the first finished part is released. The stamping machine 1 is then locked in position. Next, the robot arm 35 is swiveled, and the gripping mechanism 40 moves forward, with the extender arm 50 in the channel between the bar guide 17 and the housing of the cutting tool magazine 11. It is then possible to remove the finished part, with one or more suction cups on the top of the mechanism 40 being activated according to the required program. The finished parts are deposited, for example, on the delivery table 25. Scrap pieces can also be removed and thrown into a scrap container.

After all the finished parts have been stamped out of a blank 19, the bar guide 17 returns to its standard position, and the stamping/nibbling machine is locked again. After that, the tilt-top 20 table is raised.

For the removal of a stamped-out blank 190 at this point, only the row of suction cups 58, 60–64 located at the edge is activated, as shown in FIG. 3*b*, because the rest of the blank 19 is more or less stamped out. For this purpose, the bar guide 17 is in the same standard position as when the blanks 19 are inserted. The mechanism 40 is thus applied with its edge row to the same defined spot. For the removal and deposit in stacks of the punched-out blanks 190, such a blank 190 is transferred by the gripping mechanism 40 from the endless chain link table 16 so that it slides onto the tilt-top table 20. After the suction cups are deactivated, the gripping mechanism 40 moves into a waiting position.

Then the tilt-top table 20 is tipped, so that, as described in detail in connection with FIG. 4, the stamped-out blank 190 slides off diagonally and comes to lie on top of the other blanks in the pile.

Experience has shown that use of the peripheral auxiliary system in accordance with the invention permits optimal manipulation of the blanks, finished parts and stamped-out blanks for a stamping/nibbling machine used in conjunction with an industrial robot. The manipulation of the stamped-out blanks 190 could also be accomplished without the use of industrial robots in this case, if the bar guide 17 of the stamping/nibbling machine is suitably constructed. However, in such a case the tilt-top table 20 has the same function.

It has been shown, with the aid of FIGS. 2 and 3 that the activation of the suction cups of the gripping mechanism 40 can be done according to a program. As a refinement of this feature, the exact positioning can also be changeable and carried out according to a program. For this purpose, the suction cup holders would have to be mounted so that they can move along the frame–for example, by means of pneumatic cylinders. One design alternative would be to have the displacement path of the suction cup holders by means of a grid of program-controlled stops. For practical purposes, it will be sufficient in many cases simply to have the bracket 50 equipped in this manner.

Generally speaking, the creation of additional programming alternatives will always be a matter of exploiting the control signals that are available on the robot arm by means of a combination-recognition circuit in such a manner that the possibilities for control are multiplied. If six signals are available, then $2^6=64$ circuit variants can be used.

Those skilled in the art will understand that changes can be made in the preferred embodiments here described, and that these embodiments can be used for other purposes. Such changes and uses are within the scope of the invention, which is limited only by the claims which follow.

What is claimed is:

1. A peripheral auxiliary system for automatic feeding and unloading of a stamping/nibbling machine, comprising:

an industrial robot having a gripping mechanism for picking up blanks and stamped parts, the gripping mechnaism comprising a V-shaped frame which is shaped to carry a blank along an edge and a diagonal and a means for adhering to blanks, stamped parts and stamped-out blanks comprising a plurality of suction cups and connections to a vacuum line, said suction cups being classified in groups and being connectable in groups to the vacuum line, and said frame having an apex;

an extendable arm mounted to the frame at said apex; means for transporting and delivering stamped parts and stamped-out blanks; and means for stacking stamped-out blanks in piles, said stacking means having a delivery surface which can be swivelled and displaced in one operation.

2. The system of claim 1, wherein the extendable arm is rigid in a vertical plane and flexible in a horizontal place.

3. The system of claim 1, wherein the extendable arm has a horizontal displacement path which can be determined by a program.

4. The system of claim 1, wherein the suction cups are operable in accordance with a program.

5. The system of claim 1, wherein the suction cups are displacable on the frame.

6. The system of claim 5, wherein the suction cups are displacable in accordance with a program.

7. The system of claim 1, further comprising at least one suction cup which is independently connectable to a vacuum line and mounted on the extendable arm.

8. The system of claim 1, wherein said stacking means comprises a tilt-top table having a delivery surface which is supported by swivelled legs.

9. The system of claim 8, wherein the tilt-top table is operated in accordance with a program.

10. The system of claim 1, wherein the gripping mechanism, said transporting means and said stacking means are operated to coact with each other.

* * * * *